US005156511A

United States Patent [19]

De Smet

[11] Patent Number: 5,156,511

[45] Date of Patent: Oct. 20, 1992

[54] METHOD FOR MANUFACTURING A CLOSING STRUCTURE, OPENABLE IN A CONTROLLED MANNER, OF A CAN, IN PARTICULAR A METALLIC CAN, CLOSING STRUCTURE OBTAINED BY SAID METHOD, AND CAN INCLUDING THE CLOSING STRUCTURE

[75] Inventor: Garbriel De Smet, Nogent sur Oise, France

[73] Assignee: Sollac, Paris, France

[21] Appl. No.: 542,432

[22] Filed: Jun. 22, 1990

[30] Foreign Application Priority Data

Jun. 23, 1989 [FR] France ..... 89 08413

[51] Int. Cl.[5] ..... B21D 51/40

[52] U.S. Cl. ..... 413/8; 413/12; 413/14

[58] Field of Search ..... 413/8, 12–14, 413/62, 63; 72/333

[56] References Cited

U.S. PATENT DOCUMENTS

| | | | |
|---|---|---|---|
| 1,847,108 | 3/1932 | Hirsch | 413/12 |
| 1,848,012 | 3/1932 | Hirsch | 413/12 |
| 1,863,337 | 6/1932 | Hirsch | 413/12 |
| 1,866,469 | 7/1932 | Hirsch | 413/12 |
| 2,274,819 | 3/1942 | Becker . | |
| 2,884,699 | 10/1942 | Hothersall | 413/8 |
| 3,070,058 | 12/1962 | Boyer . | |
| 3,142,412 | 7/1964 | Blakeslee . | |
| 3,343,713 | 9/1967 | Fraze . | |
| 3,575,122 | 4/1971 | Brossart, Jr. | 72/333 |

*Primary Examiner*—Bruce M. Kisliuk
*Assistant Examiner*—Jack Lavinder
*Attorney, Agent, or Firm*—Fay, Sharpe, Beall, Fagan, Minnich & McKee

[57] ABSTRACT

Method for manufacturing a closing structure (3), openable in a controlled manner of a can, in particular a metallic can (1), the method comprising press forming the sheet blank so as to form a bulging zone, forming from the bulging zone a small curved zone, and producing in the region of the curved zone a cut-away part so as to form an aperture (5) including a peripheral skirt (10*c*), enlarging a part of the peripheral skirt (10*c*) and fixing by seaming to the aperture (5) a removable closure member (4) by forming a seamed edge portion (10*e*) constituted by the peripheral skirt (10*c*).

15 Claims, 7 Drawing Sheets

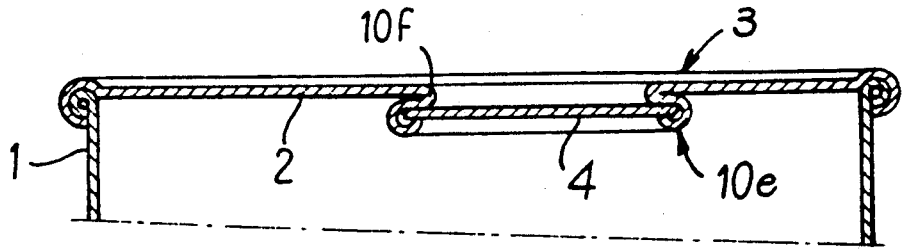
FIG. 1
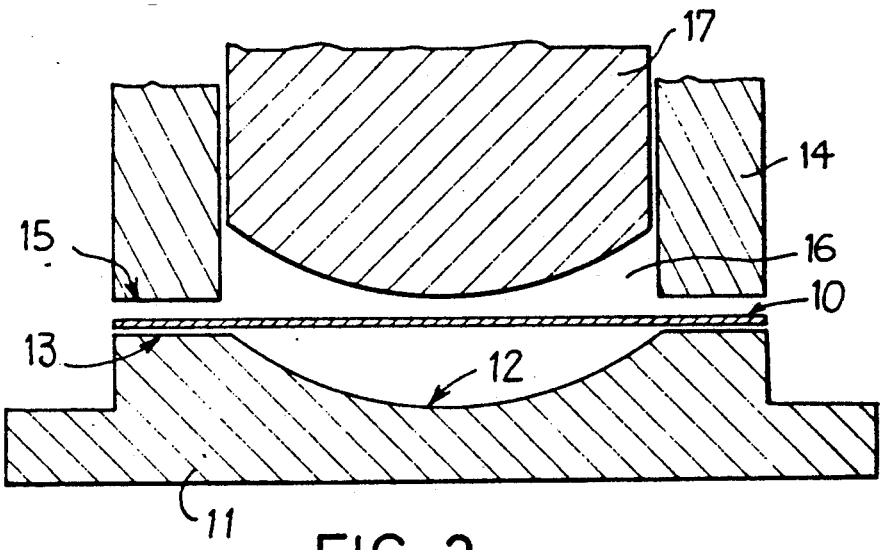
FIG. 2
FIG. 3
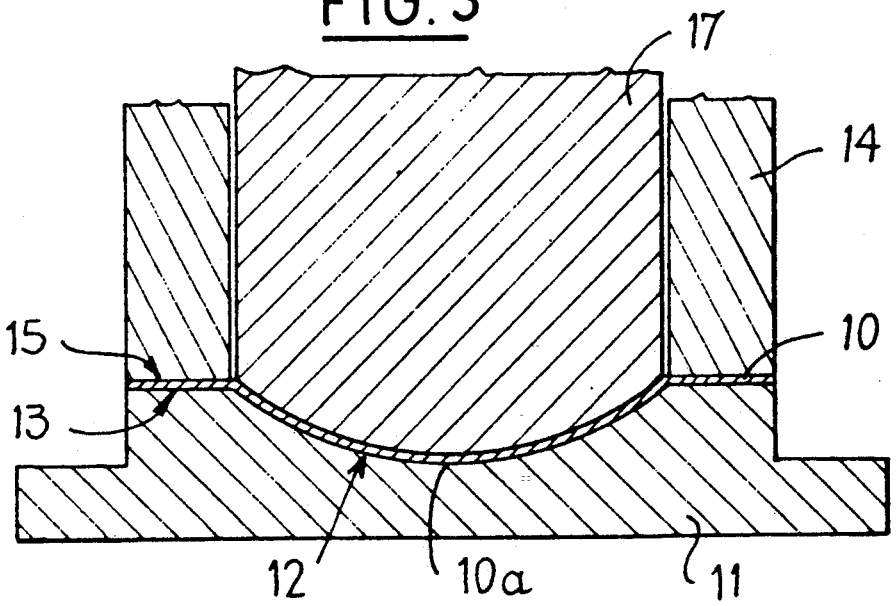

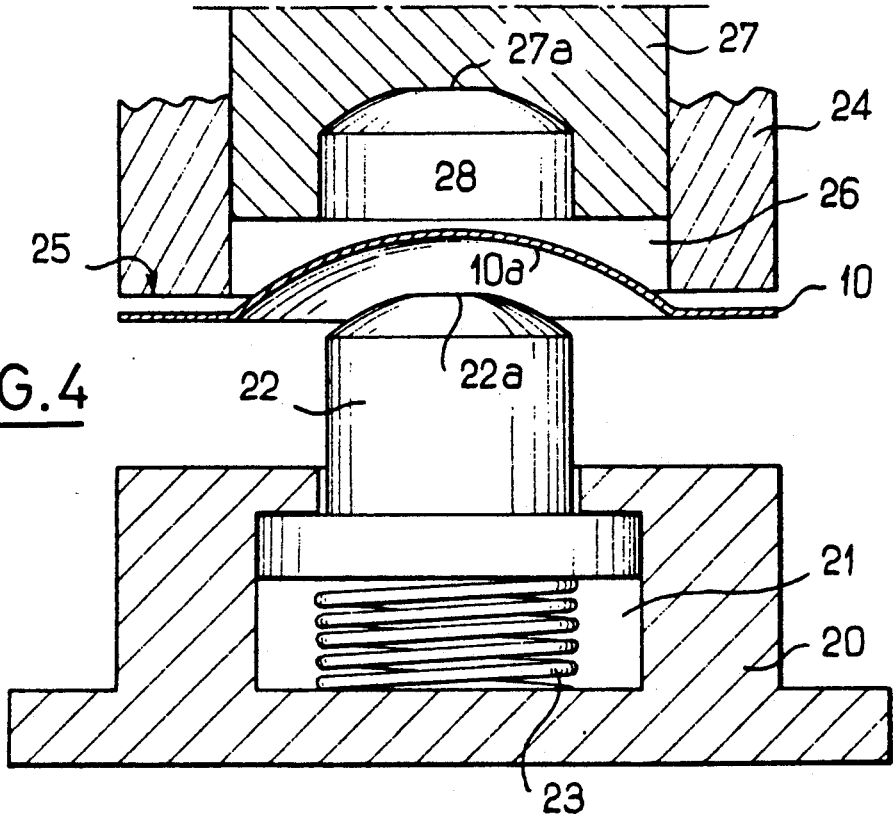
FIG.4
FIG.5
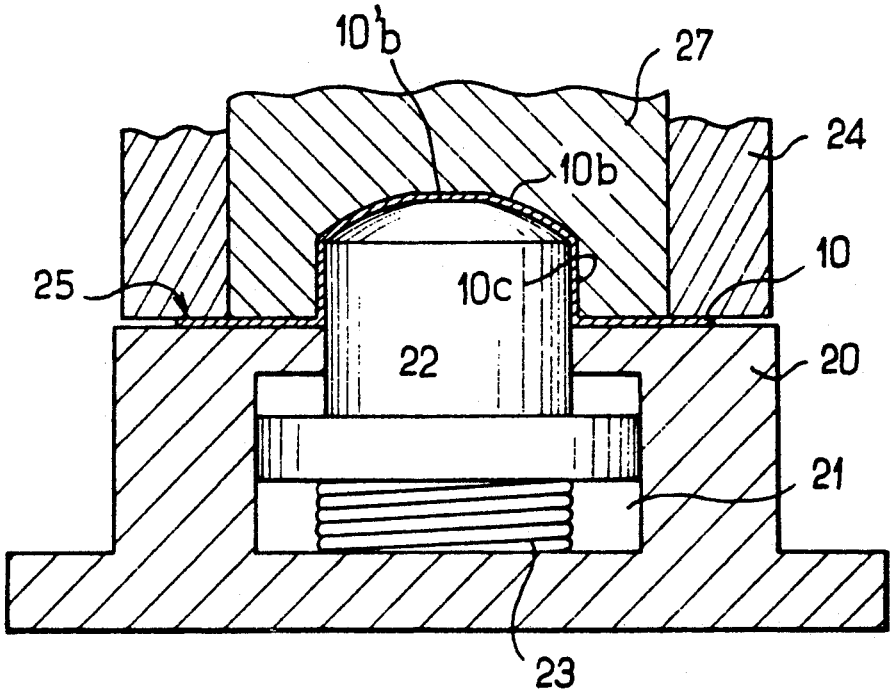

FIG.6
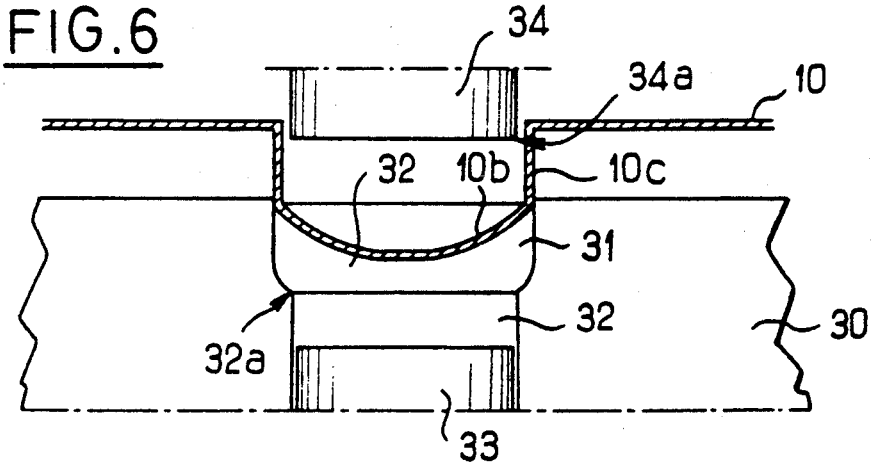
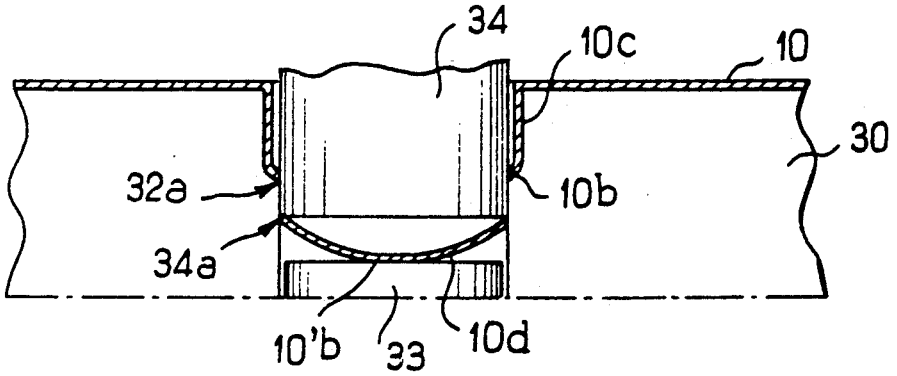
FIG.7
FIG.7a
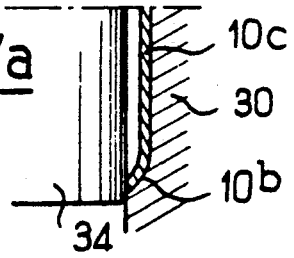
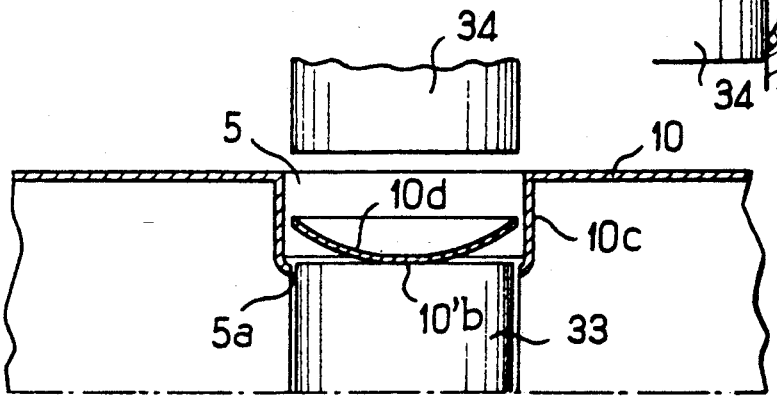
FIG.8
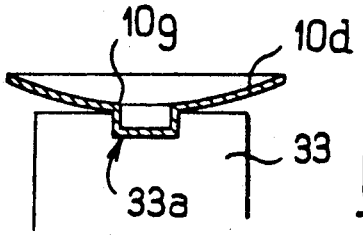
FIG.8a

METHOD FOR MANUFACTURING A CLOSING STRUCTURE, OPENABLE IN A CONTROLLED MANNER, OF A CAN, IN PARTICULAR A METALLIC CAN, CLOSING STRUCTURE OBTAINED BY SAID METHOD, AND CAN INCLUDING THE CLOSING STRUCTURE

The present invention relates to a method for manufacturing a closing structure openable in a controlled manner for cans, in particular metallic cans, or various containers, and a closing structure obtained by said method.

The present invention also relates to a can provided with said closing structure.

The opening of a can, in particular a metallic can, often requires the use of appliances of the can-opening type the use of which is sometimes dangerous and in any case difficult.

In order to dispense with can openers, manufacturers have proposed to consumers various facilitated-opening systems the use of which requires, on principle, no tool; this is in particular the case of easily-opened cans for conserving food products or metallic packing cans.

Whatever the material used for the can, all the known opening systems have for essential element an incision line surrounding a removable panel on which is fixed an opening ring provided with an incision point, i.e. an element permitting the insertion of a finger. The incision line determines a zone of reduced resistance of the lid, the incision point serves to perforate the lid in the region of the incision line and the ring serves to forcibly pull away the removable panel. The removable panel and the opening ring are assembled by welding or a press-formed rivet is provided on the lid, inserted in the ring and hammered over onto the latter.

Usually, with this type of easily openable closing structure of a can, the opening procedure which consists in turning up the ring so as to perforate the incision line, then pulling it toward oneself so as to pull away the removable panel, renders the can unstable owing to the spring effect resulting from the often brutal separation of the removable panel which is forcibly pulled away, and involves a risk of cutting the hand. Indeed, the separation of the removable panel from the rest of the closing structure forms, along the incision line on the removed panel and the lid, a sharp edge which is liable to cause cuts.

Moreover, the incision line must be formed on the closing structure with precision in order to obtain an exact positioning of the incision point with respect to said line and this requires costly tooling.

Furthermore, bearing in mind the opening movement and the presence of the incision line, stiffening means judiciously arranged on the closing structure must be provided and this complicates still further the tooling.

An object of the present invention is to avoid the aforementioned drawbacks and to provide container manufacturers and consumers with a closing member for an aperture which is easy to open, reliable and involves no risk.

The present invention therefore provides a method for manufacturing a closing structure, openable in a controlled manner, of a can, in particular a metallic can, from a sheet blank, characterized in that it comprises press-forming the sheet blank so as to form a bulging zone, forming from said bulging zone a curved zone, and producing in the region of said curved zone a cut-away part resulting in an aperture comprising a peripheral skirt, enlarging a part of the peripheral skirt, and fixing by seaming to the aperture a removable closure member by forming a seamed edge portion constituted by the peripheral skirt.

According to other features of the invention:

- a part of the peripheral skirt of the aperture is enlarged by progressively flattening the previously-curved removable closure member which is placed inside said skirt, the area of the seamed closure member being substantially identical to the area thereof before seaming and the perimeter of the seamed closure member being larger than the perimeter thereof before seaming;
- a part of the peripheral skirt of the aperture is enlarged by progressively flattening the cut-away part which constitutes the removable closure member, the area of the seamed cut-away part being substantially identical to the area thereof before seaming, and the perimeter of the seamed cut-away part being larger than the perimeter thereof before seaming;
- a part of the peripheral skirt of the aperture is enlarged by progressively flattening an elastic disk, and there is then placed inside said skirt a previously-formed removable closure member including a curved zone, and the removable closure member is fixed by seaming to the aperture by forming a seamed edge portion constituted by the peripheral skirt;
- in enlarging the peripheral skirt of the aperture, a folded edge portion is formed in the region of said aperture by maintaining the perimeter of the aperture constant.

The present invention also provides a closing structure, openable in a controlled manner, of a can, in particular a metallic can, characterized in that it comprises an aperture surrounded by a peripheral skirt in the region of which a removable closure member is seamed, a seamed edge portion formed by the peripheral skirt being set back relative to the edge of the aperture.

According to other features of the invention:

- the removable closure member is formed by a previously-formed pellet, the area of the closure member after seaming being substantially identical to the area thereof before seaming and the perimeter of the closure member after seaming being larger than the perimeter thereof before seaming;
- the removable closure member is constituted by said cutaway away part resulting in the aperture, the area of said cutaway part after seaming being substantially identical to the area thereof before seaming, and the perimeter of said cutaway part after seaming being larger than the perimeter thereof before seaming;
- the removable closure member is constituted by a pellet including a curved zone, the perimeter of the closure member being larger than the perimeter of the aperture;
- the closure member includes a ring;
- the seamed edge portion is disposed within the can;
- the seamed edge portion is disposed outside the can;
- the outer fold of the seamed edge portion is curled inwardly;
- the outer fold of the seamed edge portion is flat.

The present invention also provides a can, characterized in that it comprises an aperture openable in a controlled manner produced by the seaming of an added removable closure member.

According to other features of the invention:

the seamed edge portion is set back relative to the edge of the aperture;

the removable closure member, after seaming, is larger than the aperture.

The present invention also provides a beverage can comprising a seamed removable closure member.

Further features and advantages of the invention will be apparent from the following description thereof which is given as an example with reference to the accompanying drawings.

In the drawings:

FIG. 1 is a partial sectional view of a can provided with a closing structure according to the invention.

FIGS. 2 to 11 are diagrammatic sectional views of the different steps in the manufacture of the closing structure shown in FIG. 1.

Figure 9:
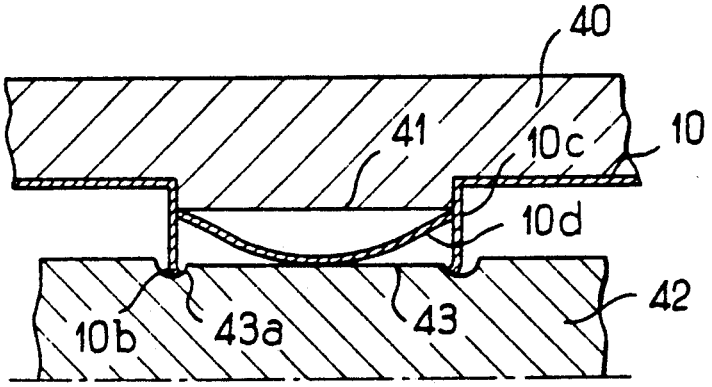

With reference first of all to FIG. 1, it can be seen that the can comprises a body 1 which has in its upper part an opening 2 on the edge of which is seamed a closing structure generally designated by the reference character 3.

This closing structure 3 comprises an aperture 5 in the region of which is seamed a removable closure member 4 which constitutes the detachable member of the can openable in a controlled manner.

With reference now to FIGS. 2 to 11, the different steps in the manufacture of the closing structure 3 will be described.

There is blanked out from a metal band (not shown) a blank 10 whose shape is identical to the opening 2 of the can and which has an area greater than the area of the opening so as to allow forming a seamed edge portion for seaming the blank 10 on the body 1.

Thereafter, different operations are carried out on the blank 10 so as to form the closing structure 3. These different operations are carried out in succession on a press comprising a series of independent press tools or one stepped press tool.

In order to simplify the description, the closing structure will be described as being formed by a succession of independent tools in the following description.

First of all, the sheet blank 10 is placed in a first press tool (FIGS. 2 and 3) comprising a base 11 constituting a die which defines in the upper part thereof an impression 12.

The die may be independent of the base 11 and placed in a recess provided for this purpose in the base.

Furthermore, the upper edge portion of the base 11 which surrounds the impression 12 constitutes a lower peripheral blank holder 13.

Above the base 11, the first press tool comprises a body 14 whose lower part constitutes an upper peripheral blank holder 15.

The body 14 has a passage 16 through which extends a punch 17 whose lower face has a shape complementary to the shape of the impression 12 of the die.

After having placed the blank 10 on the lower peripheral blank holder 13, the upper peripheral blank holder 15 is lowered in a first stage so as to grip the peripheral edge portion of the blank 10.

Thereafter, the punch 17 is lowered so that its working face comes into contact with the blank 10 and forms a central bulging zone 10*a* whose curved contour corresponds to the curved contour of the impression 12 (FIG. 3).

Following on this first stage, the blank 10 is turned over and placed in a second press tool (FIGS. 4 and 5) comprising a base 20 defining a central cavity 21 in which is mounted a movable punch 22 provided on its upper face with a small flat surface 22*a*.

The movable punch 22 cooperates with means 23 for regulating the displacement of the punch which may be for example a spring so that, in the position of rest, the upper face of the movable punch 22 is located above the upper face of the base 20.

The second press tool also comprises a body 24 whose lower part constitutes an upper peripheral blank holder 25. This body 24 defines a passage 26 in which is slidable a die 27 whose lower face is provided with an impression 28 whose shape is complementary to the shape of the movable punch 22. The impression 28 also includes a small flat surface 27*a*.

The blank 10 is placed on the upper face of the base 20 and, in a first stage, the upper peripheral blank holder 25 is lowered so as to grip the peripheral edge portion of the blank. The die 27 is lowered progressively so that a portion of the bulging zone 10*a* enters the impression 28 under the action of the movable punch 22 and forms from said bulging zone 10*a* a small curved zone 10*b* which is connected to the rest of the blank 10 by a substantially vertical peripheral skirt 10*c*. The curved zone 10*b* includes a flat surface 10'*b*.

In the course of the descent of the die 27, the movable punch 22 also descends and this compresses the spring 23.

After this second stage, the press-formed blank 10 is once again turned over and placed in a punching tool (FIGS. 6 to 8).

This punching tool comprises a die 30 defining an impression 31, whose shape is complementary to the curved shape (10*b*, 10*c*) formed on the blank 10, and a passage 32 extending from this impression. The intersection between the impression 31 and the passage 32 constitutes a cutting edge 32*a*.

A push-member 33 is slidably mounted in the passage 32.

The punching tool further comprises, on the axis of the passage 32, a punch 34 which has a shape complementary to the shape of the passage and defines on the lower edge thereof a cutting edge 34*a*.

The blank 10 is placed on the upper face of the die 30 so that the curved zone (10*b*, 10*c*) is lodged in the impression 31.

Thereafter, the punch 34 is progressively lowered until its cutting edge 34*a* comes into contact with the curved zone 10*b*, then passes beyond the cutting edge 32*a* (FIG. 7*a*) and forms in this curved zone an opening 5*a*. The cut-away part 10*d* thus produced separates from the rest of the blank 10 and drops onto the push-member 33 (FIG. 7). The cut-away part 10*d* rests on the push-member 33 through the flat surface 10'*b* thereof so as to avoid any tilting of this part.

This cut-away part 10*d*, at this stage of the method, has the same dimensions as the opening 5*a* formed in the blank 10.

After having raised the punch 34, the push-member 33 rises and passes the cut-away part 10*d* through the opening 5*a* and positions it above the edge of the curved zone 10*b*, as shown in FIG. 8.

The cut-away part 10*d* easily passes through the opening 5*a* owing to the fact that, when it is punched out, the cutaway part tends to shrink slightly.

Thereafter, the punch 34 is lowered so as to slightly flatten the cut-away part 10*d*, thereby causing the edge of the latter to come into contact with the skirt 10*c*, which maintains the cut-away part in position when transferring to the following tool.

In a variant shown in FIG. 8*a*, the cut-away part 10*d* may be maintained on the push-member 33 by a spigot 10*g* which is formed on the cut-away part and fits into a recess 33*a* in the push-member 33.

Figure 10:
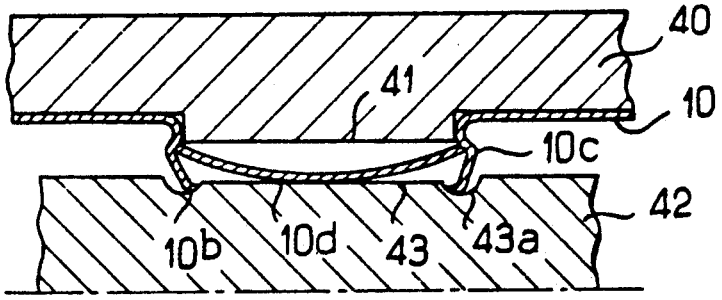
Figure 11:
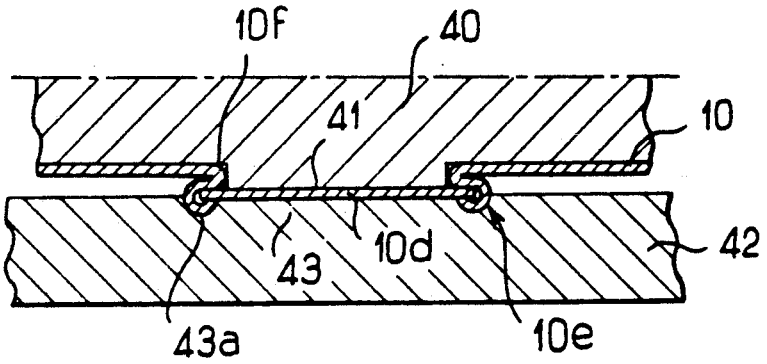

Thereafter, the assembly comprising the blank 10 and the cut-away part 10*d* is transferred to a seaming tool (FIGS. 9 to 11).

This seaming tool comprises an upper punch 40 and a lower anvil 42, both of these elements being vertically movable toward each other.

The upper punch 40 includes a projecting portion 41 having a shape complementary to the shape of the skirt 10*c* formed in the blank 10. The anvil 42 defines a groove 43*a* which delimits a central part 43 whose shape is complementary to the shape of the aperture formed in the blank. The groove 43*a* serves to curl the end portion of the skirt 10*c* round the cut-away part 10*d* in the manner described hereinafter.

The projecting portion 41 of the punch 40 enters the skirt 10*c* and blocks the edge of the skirt and the central part 43 of the anvil 42 enters the opening 5*a* of the blank 10 as shown in FIG. 10.

In this position, the edge portion 10*b* bears against the bottom of the groove 43*a*. Further, the edge portion of the cut-away part 10*d* bears against the projecting portion 41 and is positioned substantially half-way up the skirt 10*c* while the bottom of the cut-away part 10*d* bears against the central part 43 of the punch 42.

As the two elements 40 and 42 move toward each other, the cut-away part is progressively flattened so that the edge of the cut-away part 10*d* buckles the skirt 10*c*. This buckling is accentuated by the movement of the anvil 42 which acts on the edge portion 10*b* (FIG. 10). At the same time, a folded edge portion 10*f* is formed in the region of the aperture 5, the perimeter of the aperture 5 remaining constant.

At the end of the operation, the cut-away part 10*d* is completely flattened and seamed in the seam fold 10*e* which is formed under the action of the punch 40 and the anvil 42, as shown in FIG. 11.

The groove 43*a* curls the outer edge portion of the seam fold 10*e* toward the interior in such manner that the cutting edge of the fold is inserted into the cut-away part 10*d* and thereby avoids oxidation of said edge.

Furthermore, the seamed edge portion 10*e* is set back relative to the folded edge portion 10*f* forming the aperture 5.

Owing to the initial curved shape of the cut-away part 10*d*, the area of the seamed cut-away part is substantially identical to the area thereof before seaming, but the perimeter of the seamed cut-away part is larger than the perimeter thereof before seaming so that it can be pinched in the folds in the course of the seaming operation.

In this way, a closing structure 3 is produced which comprises a removable seamed closure member 4 constituted by the cut-away part 10*d* itself, it being sufficient to seam this closing structure on the body 1 of the can (FIG. 1) to produce a hyper-sealed closure.

The seal is achieved, on one hand, in the region of the peripheral edge portion of the closure member 4 and, on the other hand, in the region of the edge of the seam fold 10*e*.

In a variant, the closure member is not formed by the cut-away part 10*d* itself, but by a pellet blanked out from a metallic band from which the blank 10 is blanked out, but in a different region, or from a different metallic band. In this case, the pellet is previously formed so as to produce a curved contour identical to that of the cut-away part 10*d* and the seaming operation is carried out in the same way as before.

In another variant, the closure member 4 may be formed from a material which is different from the material of the blank 10 or has a different colour and then seamed, as before, with the edge portion of the aperture 5 formed in said blank. In this case, the closure member also has the same area and the same curved contour as the cut-away part 10*d* formed in the blank.

Figure 12:
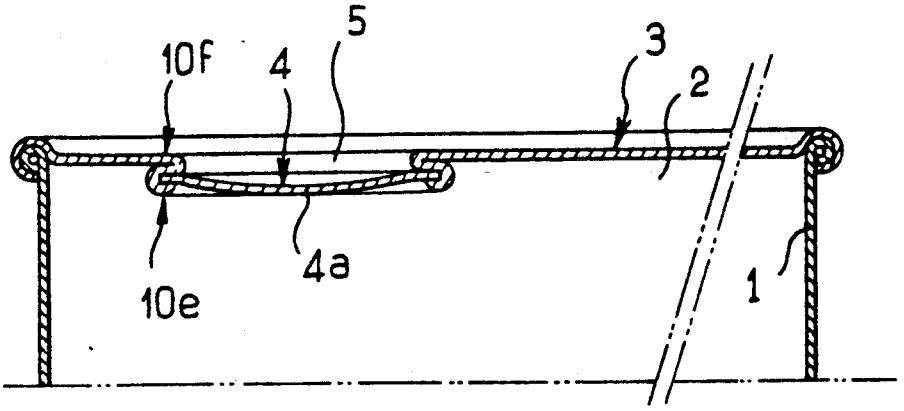
FIG. 12 is a partial sectional view of a can provided with a closing structure according to a second embodiment of the invention.

In a further variant illustrated in FIG. 12, the closure member 4 comprises a curved zone 4*a* which is for example convex toward the interior of the can 1.

In this case, the closure member 4 is not formed by the cut-away part 10*d* produced directly from the blank 10 as in the preceding variant, owing to the provision of the curved zone 4*a*.

Indeed, owing to the presence of this curved zone 4*a* on the closure member 4, this closure member cannot be flattened for enlarging the skirt 10*c*.

This is why the closure member 4 is formed by a pellet blanked out from the metallic band from which the blank 10 is blanked out, but in a different region, or from another metallic band, and formed in such manner as to produce the curved zone 4*a*. In this case, the closure member 4 has a perimeter which is larger than the perimeter of the aperture 5.

With reference now to FIGS. 13 to 16, there will be described the different steps of the manufacture of the closing structure shown in FIG. 12.

Figure 13:
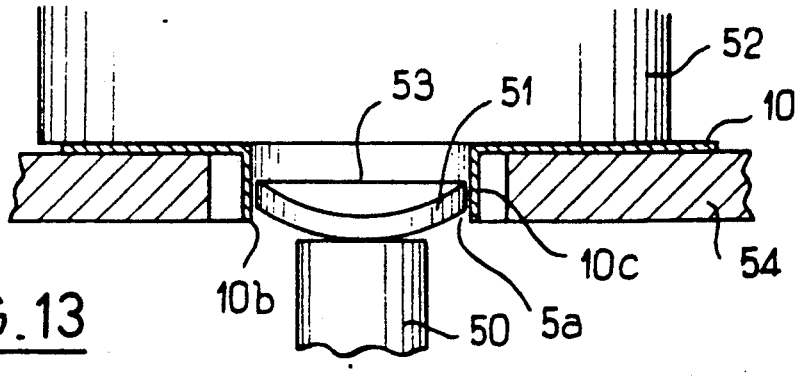
FIGS. 13 to 16 are diagrammatic sectional views of the different steps in the manufacture of the closing structure shown in FIG. 12.
Figure 14:
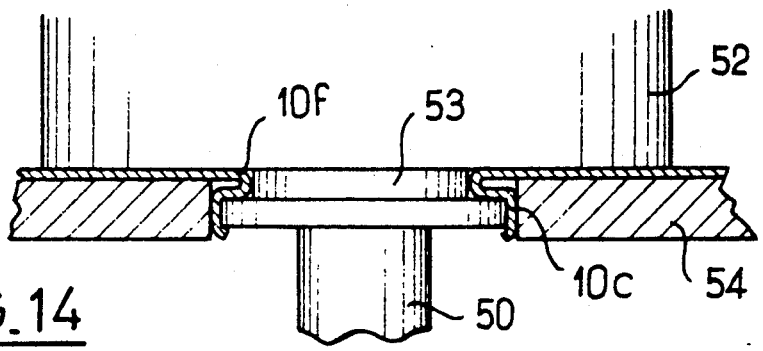
Figure 15:
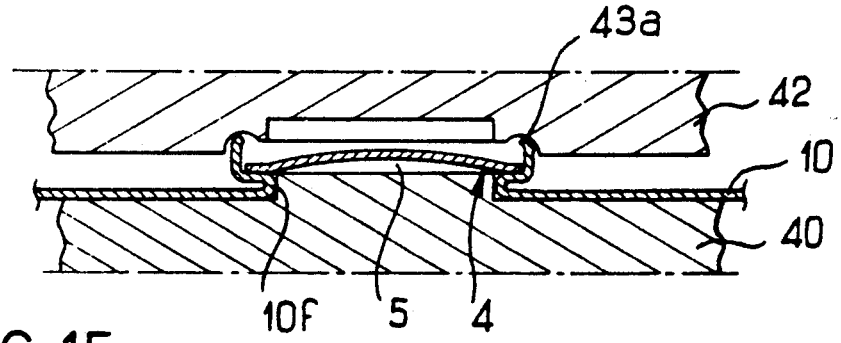
Figure 16:
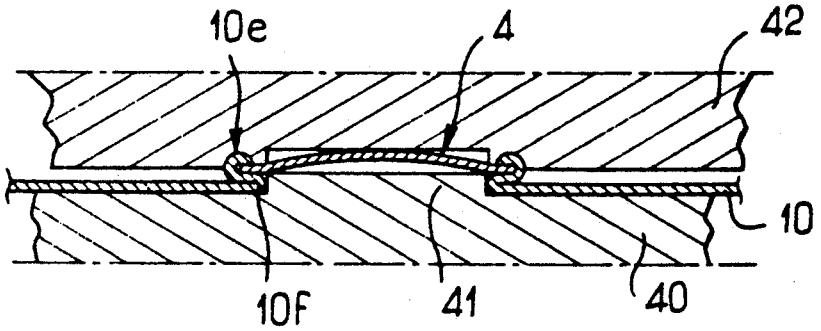

The blank 10, in which the skirt 10*c* and the aperture 5*a* have been previously formed, is placed in a forming tool (FIGS. 13 and 14).

This tool comprises a lower punch 50 including an elastic disk 51 whose shape is complementary to the shape of the skirt 10*c*.

The tool further comprises an upper punch 52 including a projecting portion 53 whose shape is complementary to the shape of the skirt 10*c* and extends into the latter.

A member 54 constituting a stop is placed at a distance from and around the skirt 10*c*.

Moving the punches 50 and 52 toward each other causes the progressive flattening of the disk 51 which enlarges a part of the skirt 10*c*. Simultaneously, an initial portion of a folded edge portion 10*f* is formed in the region of the aperture 5 while the perimeter of the latter is maintained constant.

The skirt 10*c* may also be enlarged by means of a cushion of elastomeric material which is deformed under the action of a punch.

The member 54 limits the enlarging of the skirt 10*c* and contributes to the formation of the vertical edge portion of this skirt.

Thereafter, the blank 10 formed in this way is placed in a seaming tool which is identical to that shown in FIGS. 9 to 11 and comprises two punches 40 and 42 (FIGS. 15 and 16), and the previously-formed closure member 4 is positioned in the skirt 10*c*.

By moving the punches 40 and 42 towards each other, the closure member 4 is seamed in the blank 10.

In the course of this operation, the folded edge portion 10*f* is flattened, and, owing to the provision of the groove 43*a*, the outer edge portion of the seam fold 10*e* is curled inwardly in such manner that the cutting edge of this fold is embedded in the closure member 4, ensures the seal and avoids oxidation of this edge.

The seamed edge portion 10*e* is also set back relative to the folded edge portion 10*f*.

Thereafter, it is sufficient to turn over the closing structure formed in this way and to seam it to the body of the can 1 so that the convex side of the curved zone 4*a* of the closure member 4 is facing toward the interior of the can.

In this case, the closure member 4 may also be formed from a material which is different from the material of the blank 10 or it may have a different colour.

To open the closing structure 3 in the embodiments thereof described hereinbefore, it is sufficient to press in the closure member 4 which drops inside the can, thereby avoiding pellets which are separated toward the exterior of the can which often litter public places.

The control of the force required to open the can is achieved in the course of manufacture by the regulation of the forces achieving the seaming of the closure member.

Figure 17:
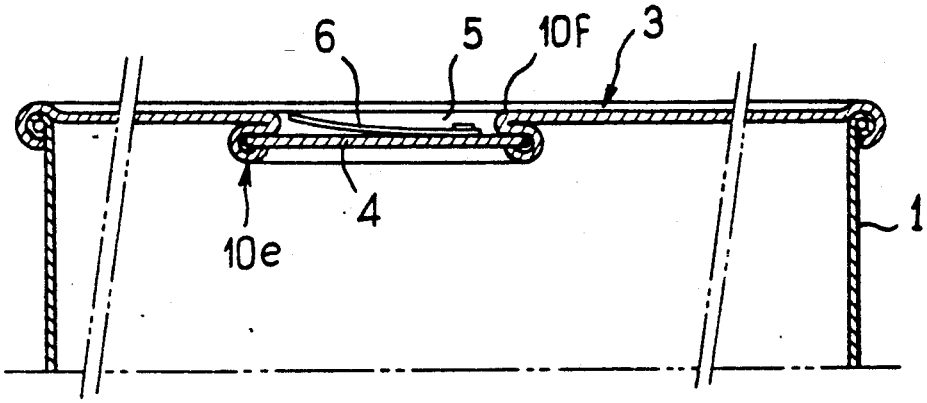
FIG. 17 is a partial sectional view of a can provided with a closing structure according to the invention and including means for extracting the closure member.

According to another embodiment illustrated in FIG. 17, the closure member 4 may be provided with a ring 6 riveted or welded to the closure member, whereby it is possible to pull on the closure member to open the can.

The closing structure according to the invention has the advantage, among others, of being devoid of any accessible sharp edge which might produce cuts when opening the can, and protecting from the food product the edge surrounding the aperture in which the closure member is seamed.

Furthermore, the closure member may have any desired dimension, any shape, such as a round, triangular, or elliptical shape adapted to each type of can, and the closing structure may include a plurality of closure members which are fixed to the can by seaming and detachable.

The removable closure member may be alternatively provided on said body of the can or on the bottom of the latter.

The invention is also applicable to any cans, in particular metallic cans, to various containers and for example to beverage cans.

What is claimed is:

1. Method for manufacturing a closing element, openable in a controlled manner, of a can, in particular a metallic can, comprising taking a sheet blank, press-forming said sheet blank so as to form a bulging zone therein, forming from said bulging zone a curved zone, producing a cut-away part in the region of said curved zone so as to provide an aperture including a peripheral skirt, enlarging a part of said peripheral skirt, and fixing by seaming to said aperture a removable closure member comprising the cut-away part by forming a seamed edge portion constituted by said peripheral skirt.

2. Method according to claim 1, wherein said step of enlarging a part of said peripheral skirt includes the subsidiary step of progressively flattening said removable closure member which has been previously curved and placed inside said skirt, an area of the said seamed closure member being substantially identical to the area thereof before seaming, and a perimeter of said seamed closure member being larger than the perimeter thereof before seaming.

3. Method according to claim 1, wherein said step of enlarging a part of said peripheral skirt includes the subsidiary step of progressively flattening said cut-away part which constitutes said removable closure member, an area of said seamed cut-away part being substantially identical to the area thereof before seaming, and a perimeter of said seamed cut-away part being larger than the perimeter thereof before seaming.

4. Method according to claim 1, wherein said step of enlarging a part of said peripheral skirt comprises the subsidiary steps of progressively flattening a curved elastic disk, thereafter placing inside said skirt a removable closure member which has been previously formed and includes a curved zone, and seaming said removable closure member on said aperture by forming a seamed edge portion constituted by said peripheral skirt.

5. Method according to claim 1, further comprising the step of forming, during said step of enlarging said peripheral skirt, a folded edge portion in the region of said aperture by maintaining the perimeter of said aperture constant.

6. A method for manufacturing a can closure element, comprising:

forming a bulging zone in a sheet blank;

removing a portion of the blank, comprising a portion of the bulging zone, from the blank to form in the blank an aperture with a peripheral skirt;

placing a curved member within the peripheral skirt;

enlarging a part of the peripheral skirt by flattening the curved member; and, seaming a closure member to the peripheral skirt.

7. The method of claim 6 wherein the portion of the bulging zone which is removed from the blank comprises the closure member, wherein the closure member is the member placed inside the peripheral skirt and wherein said step of enlarging a part of the peripheral skirt comprises the subsidiary step of progressively flattening the closure member so that an outer periphery thereof contacts the peripheral skirt and pushes it outwardly.

8. The method of claim 6 wherein the closure member is curved and the closure member is the member placed within the peripheral skirt and wherein said step of enlarging a part of the peripheral skirt comprises the subsidiary step of progressively flattening the closure member so that an outer periphery thereof contacts the peripheral skirt and pushes it outwardly.

9. The method of claim 6 further comprising the step of forming, during said step of enlarging a part of the peripheral skirt, a folded edge portion in the peripheral skirt by maintaining the perimeter of the aperture constant.

10. The method of claim 6 further comprising the step of securing a pull-tab to the closure member before said step of seaming the closure member to the peripheral skirt.

11. A method for manufacturing a can closing structure, comprising:

forming a bulging zone in a sheet blank;

removing a portion of the bulging zone from the blank to form, from the removed portion, a closure member and, from the remaining portion, a wall element having an aperture with a peripheral skirt;

enlarging a part of the peripheral skirt of the wall element wherein the part which is enlarged is spaced from the aperture; and, seaming the closure member to the peripheral skirt of the wall element.

12. The method of claim 11 wherein said step of enlarging a part of the peripheral skirt comprises the subsidiary steps of:

placing the closure member inside the peripheral skirt; and, progressively flattening the closure member so that an outer periphery thereof contacts the peripheral skirt and pushes it outwardly.

13. The method of claim 11 further comprising the step of forming, during said step of enlarging the peripheral skirt, a folded edge portion in the region of the aperture of the peripheral skirt by maintaining the perimeter of the aperture constant.

14. The method of claim 11 further comprising the step of securing a pull-tab to said closure member before said step of seaming the closure member to the peripheral skirt.

15. The method of claim 11 further comprising the step of seaming the wall element to a can.

* * * * *